United States Patent [19]

Heaney et al.

[11] Patent Number: 4,737,264

[45] **Date of Patent: * Apr. 12, 1988**

[54] HEAVY OIL DISTILLATION SYSTEM

[75] Inventors: William F. Heaney, Hamilton Township; Albert R. Nitsch, Princeton, both of N.J.

[73] Assignee: Mobil Oil Corporation, New York, N.Y.

[ * ] Notice: The portion of the term of this patent subsequent to Jun. 2, 2004 has been disclaimed.

[21] Appl. No.: 55,567

[22] Filed: May 29, 1987

Related U.S. Application Data

[63] Continuation of Ser. No. 680,711, Dec. 12, 1984, abandoned.

[51] Int. Cl.[4] ..... C10G 9/14; C10B 55/00

[52] U.S. Cl. ..... 208/131; 208/50

[58] Field of Search ..... 208/131, 50, 127, 354, 208/357

[56] References Cited

U.S. PATENT DOCUMENTS

| | | | |
|---|---|---|---|
| 2,469,332 | 5/1949 | Evans | 196/52 |
| 2,901,418 | 8/1959 | Pappas | 208/354 X |
| 2,999,002 | 9/1961 | Henderson | 208/354 |
| 3,344,057 | 9/1967 | Patrick | 208/131 X |
| 3,412,009 | 3/1967 | Smith et al. | 208/72 |
| 3,501,400 | 3/1970 | Brody | 208/361 |
| 3,878,088 | 4/1975 | Nahas et al. | 208/50 |
| 3,886,062 | 5/1975 | Peiser et al. | 208/354 |
| 3,917,564 | 8/1974 | Meyers | 208/131 |
| 4,075,084 | 2/1978 | Skripek et al. | 208/131 |
| 4,177,133 | 12/1979 | Hayashi et al. | 208/131 |
| 4,191,640 | 3/1980 | Chess et al. | 208/357 |
| 4,239,618 | 12/1980 | Peiser et al. | 208/355 |
| 4,261,814 | 4/1981 | Pfeifer | 208/356 |
| 4,404,092 | 9/1983 | Audeh et al. | 208/131 |
| 4,415,443 | 11/1983 | Murphy | 208/354 X |
| 4,443,325 | 4/1984 | Chen et al. | 208/131 X |
| 4,455,219 | 6/1984 | Janssen et al. | 208/131 |
| 4,670,133 | 6/1987 | Heaney et al. | 208/131 |

FOREIGN PATENT DOCUMENTS

| | | | |
|---|---|---|---|
| 1298098 | 11/1972 | United Kingdom . | |
| 433198 | 10/1975 | U.S.S.R. | 208/131 |

*Primary Examiner*—Helen M. S. Sneed
*Assistant Examiner*—Glenn Caldarola
*Attorney, Agent, or Firm*—Alexander J. McKillop; Michael G. Gilman; Malcolm D. Keen

[57] ABSTRACT

A fractionation method and apparatus is disclosed for separating and recovering condensed and absorbed coke vapor from residual material leaving a coker combination tower to thereby obtain increased distillate yield. A resid flash down tower is positioned between the coker combination tower and a delayed coke furnace and operated to recover the higher value liquid product from the residual material containing absorbed coke vapor.

3 Claims, 1 Drawing Sheet

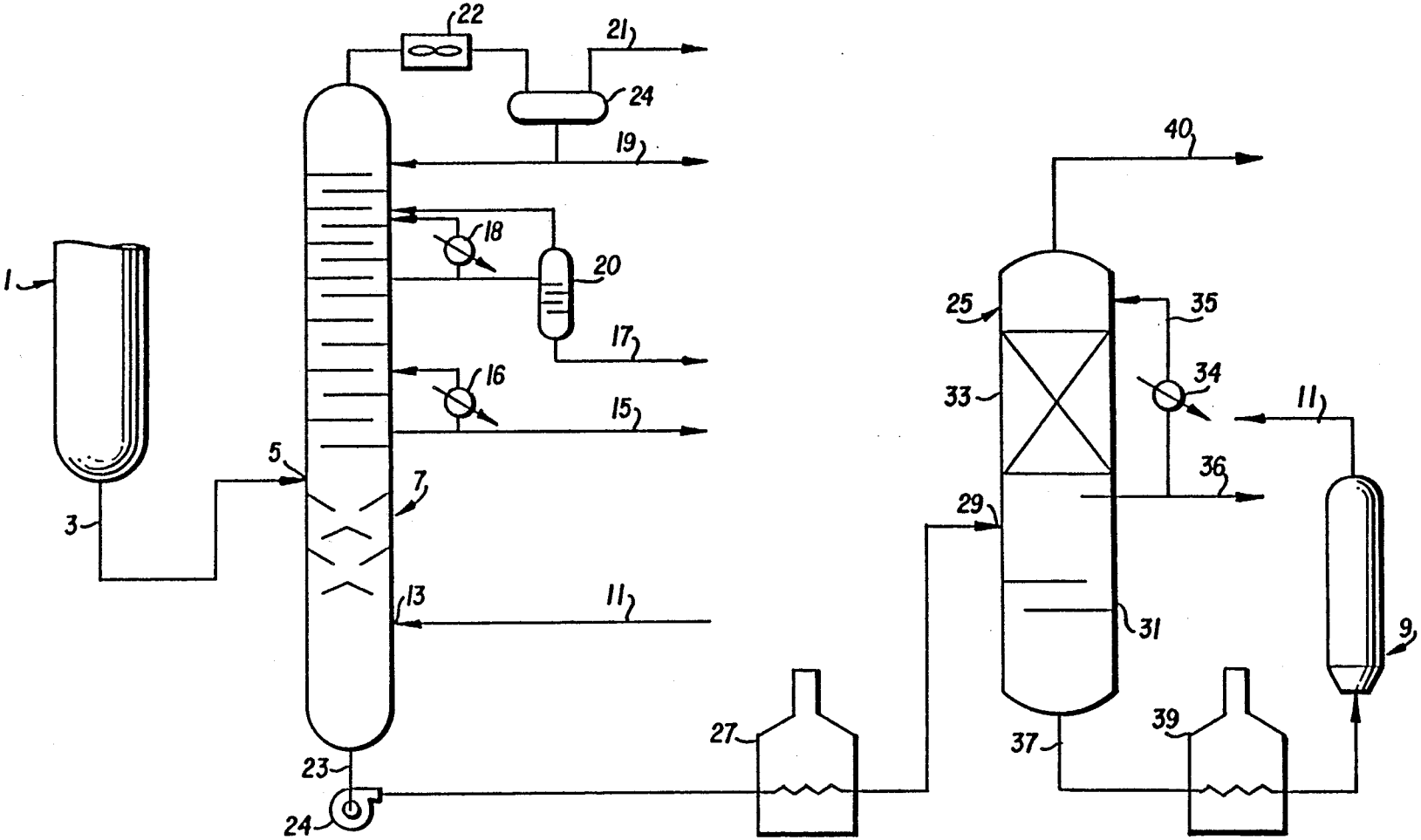
1
3
5
7
9
11
13
15
16
17
18
19
20
21
22
23
24
25
27
29
31
33
34
35
36
37
39
40

HEAVY OIL DISTILLATION SYSTEM

This is a continuation of copending application Ser. No. 680,711, filed on Dec. 12, 1984 allowed.

BACKGROUND OF THE INVENTION

1. Field of the Invention

This invention relates to an improved method for recovering volatiles generated by a coke drum. In particular, it relates to a vacuum residuum flashdown technique for separating absorbed coke drum vapors from coker combination tower residuum.

2. Discussion of the Prior Art

Processing of crude petroleum oil to recover fractions suitable for upgrading in various refinery processing operations employs multi-stage distillation towers. Crude oil is first distilled or fractionated in an atmospheric distillation tower and further separated in a vacuum distillation tower. In this combination operation, gas ($C_4-$) and gasoline are recovered as overhead products of the atmospheric distillation tower, heavy naphtha, kerosene and gas oils are taken off as distillate side streams and the residual material is recovered from the bottom of the atmospheric tower as reduced crude. The residual bottoms fraction is usually charged to a vacuum distillation tower. The products of vacuum distillation include vacuum gas oils and a heavy residual material known as vacuum reduced crude. The vacuum reduced crude is fed into a coker combination tower, where it quenches, and recovers heat from hot vapor from a coke drum or furnace (hereinafter coke drum). The residual crude, which is not vaporized by the heat of the vapor from the coke drum in the coker combination tower, is then fed to the coke drum as a feedstock for coke manufacture.

Typical prior art distillation techniques are disclosed in U.S. Pat. Nos. 3,501,400; 3,886,062; 4,239,618 and 4,261,814. A typical coker combination tower and coke drum is disclosed in U.S. Pat. No. 3,917,564.

SUMMARY OF THE INVENTION

When vacuum reduced crude is used to quench coke drum vapor in a coker combination tower, a portion of the coke drum vapor condenses and is unavoidably absorbed by the vacuum reduced crude and recycled to the coke drum. Since part of this recycled material ends up as coke in the coke drum, the yield of coke is increased at the expense of a higher value liquid product.

The present invention is directed to a fractionation technique for separating and recovering condensed and absorbed coke drum vapor from the residual material of the coker combination tower to obtain increased distillate yield. This is accomplished by an auxiliary distillation tower (hereinafter referred to as a resid flash down tower) positioned in the residuum stream between the coker combination tower and the coke drum.

Accordingly, it is an object of the present invention to increase the yield of useful and valuable distillate range fractions, decrease the yield of coke, and permit increased reflux rate in the coker combination tower.

It is another object of the present invention to flash a coker combination tower residuum prior to feeding the residuum to a coke drum to thereby increase the amount of residuum fed to the delayed coke furnace, and decrease the amount of valuable distillate range fractions fed to the delayed coke furnace.

The fractionation technique is generally used in a system which includes a main vacuum distillation tower for fractionating the atmospheric tower bottoms; a coke drum; a coker combination tower for producing naphtha, light gas oil, heavy gas oil and residuum crude from a countercurrent flow of vacuum tower residuum and vapor from the coke drum; and, a resid flash down tower for fractionating a vacuum tower residuum stream containing absorbed coke drum vapor.

The method of the invention includes recovering absorbed coke drum vapor from residuum of a fractionating tower comprising feeding the residuum to a resid flash down tower operating at a lower pressure than the fractionating tower, volatilizing at least a portion of the absorbed coke drum vapor from the residuum, and recovering the coke drum vapor. The preferred lower pressure is an absolute pressure of from 0.5 mmg Hg (67 Pa) to 10 mm Hg (1333 Pa).

The apparatus of the invention is a multistage fractionation and coking system for separating the components of a petroleum residuum from a first distillation tower, the residuum containing absorbed coke drum vapor, the apparatus comprising: a multi-zone resid flash down tower; means for introducing the residuum containing absorbed coke drum vapor at elevated temperature to the resid flash down tower; maintaining the resid flash down tower at a pressure below the pressure in the first distillation tower, whereby volatile components of the residuum are flashed; and means for separating and recovering the volatile components from the residuum. The reduced pressure used in flashing is preferably an absolute pressure of from 0.5 mm Hg (67 Pa) to 10 mmg Hg (1333 Pa).

These and other objects and advantages of the invention will be seen in the following description and in the drawing.

BRIEF DESCRIPTION OF THE DRAWING

The sole FIGURE is a process flowsheet demonstrating a heavy oil vacuum distillation system incorporating the method and apparatus of the invention.

DESCRIPTION OF A PREFERRED EMBODIMENT

Referring to the FIGURE, atmospheric distillation tower residuum or similar heavy oil is preheated in a furnace (not shown) and fed into a lower fractionation zone of main vacuum distillation tower 1, whereby the crude feedstock flashes and separates into a downward liquid stream called a vacuum residuum. The vacuum residuum is withdrawn through conduit 3 at a temperature of approximately 315° C. (600° F.) and is fed into residuum inlet 5 of coker combination tower 7.

At a different location in the system, residuum stripped of volatiles and further heated to convert it to coke is fed to a coke drum 9. In the process, some cracking and some volatilization of residuum occurs, generating coke drum vapor. The coke drum vapor, at a temperature of approximately 432° C. (810° F.), passes through conduit 11 to coker combination tower inlet 13, positioned below residuum inlet 5. The vapor then passes upwardly in a countercurrent heat exchange relationship with the vacuum distillation tower residuum fed into inlet 5. The vacuum tower residuum quenches, preventing further cracking, condenses and absorbs a considerable amount of the coke drum vapor.

Non-absorbed coke drum vapors are fractionated in the coker combination tower 7 into heavy gas oil discharged through conduit 15, light gas oil discharged through conduit 7, naphtha discharged through conduit 19, gas discharged through conduit 21, and coker combination tower residuum discharged through conduit 23.

In the operation of the coker combination tower 7, pumparound heat exchanger 16 cools heavy gas oil from conduit 15 and recycles it to the coker combination tower 7, and pumparound heat exchanger 18 cools and recycles the light gas oil. A side stripper 20 is employed to fractionate the light gas oil. An oil fin cooler 22 is used to cool the gas discharged from coker combination tower 7. Overhead drum 24 separates overhead liquid from vapor, and the liquid is split into product and reflux.

Resid flash down tower 35 is operatively connected to receive the coker combination tower residuum containing absorbed coke drum vapor from coker combination tower 7. The coker combination tower residuum is pumped through conduit 23 by pump 24 and, to provide further heating, the feed to resid flash down tower 25 is passed through furnace 27 to feed inlet 29. The resid flash down tower 25 has a lower fractionation zone 31 disposed below the coker combination tower residuum feed inlet 29. An upper condensing zone 33, cooled by a pumparound heat exchanger 34 positioned in a stream from conduit 35, is located above the residuum feed inlet 29. The residuum from conduit 23 contains condensed and absorbed vapor from the coke drum 9 and passes downwardly through the resid flash down tower 25, where absorbed coke drum vapors are released. The stripped residuum is withdrawn from the bottom of resid flash down tower 25 via conduit 37 and is fed through delayed coke furnace 39 to coke drum 9.

A clean distillate product consisting of virgin gas oil and condensed coke drum vapor is recovered as a liquid from the upper condensing zone 33 of resid flash down tower 25 by way of of conduit 36. Reflux in the upper condensing zone 33 is provided by recirculating and cooling a portion of the clean distillate by way of control 35. Lighter hydrocarbons and water are withdrawn through top vapor outlet 40. Vacuum is maintained in the tower by a steam jet ejector (not shown).

While this embodiment has been described and shown as a combination vacuum main tower 1, coker combination tower 7, resid flash down tower 25 and coke drum 9, it is understood that the components employed may be replaced by obvious equivalents, and operating pressure and flow patterns may be varied widely within the inventive concept. The pressure range which can be employed in the resid flash down tower varies from 0.5 mm Hg (67 Pa) to 20 mm Hg (1666 Pa). There can be a pressure differential of from 2 mm Hg (267 Pa) to 5 mm Hg (666 Pa) from the upper zone to the lower zone in the resid flash down tower 25.

The temperature in the coker combination tower 7 is not critical and generally ranges from 412° C. (775° F.) to 454° C. (850° F.). The pressure in the coker combination tower can range from 103 kPa gauge (15 psig) to 414 kPa gauge (60 psig). The temperature of the coker combination tower residuum generally varies from 149° C. (300° F.) to 371° C. (700° F.). The temperature of the coke drum vapors fed to the coker combination tower generally vary from 413° C. (775° F.) to 454° C. (850° F.). The conditions for quenching coke drum vapors in a coker combination tower are known in the art and wide latitude is possible.

The inventive concept involved herein relates to stripping residuum of coke drum vapor, condensing the vapor and recovering the condensate. The condensate is recovered in addition to the virgin gas oil recovered by the resid flash down tower 25. The upper fractionation zone of the resid flash down tower 25 assures economic recovery of higher value distillate from otherwise lower value bottoms from the coker combination tower.

In the following example, based upon pilot plant studies, a vacuum distillation system is employed to fractionate crude. Utilizing the continuous system of a refinery scale unit (100,000 B/D), the main vacuum distillation tower is operated to produce 25,000 B/D of vacuum resid. Stream conditions for the resid flash down tower are shown in Table 1.

TABLE 1

| Stream | Temperature °C./(°F.) | Flow Rate (B/D) |
|---|---|---|
| Residuum inlet from coker combination tower | 412/(775) | 25,000 |
| Virgin Gas Oil Product | 610–616/ (1130–1140) | 3,460 |
| Condensed Coke Drum Vapor | 440–538/ (825–1000) | 750 |
| Virgin Gas Oil Pump-Around | 121/(250) | — |
| Residuum Product | 616+/(1140+) | 21,540 |

In the above example, the resid flash down tower 25 vacuum system maintains an absolute pressure of about 3 mm Hg (or about 400 Pa) in the lower fractionating zone, and an absolute pressure of about 1 mm Hg (or about 133.3 Pa) above the upper condensing zone.

The distillate products recovered from the upper condensing zone may be used as heating oil, diesel fuel, feedstock for a fluid catalytic cracking (FCC) unit, catalytic dewaxing, or other downstream processing.

In the above example, the distillate recovered from the residuum streams substantially increases the total distillate recovered from the system.

While a specific embodiment of the method and apparatus of the invention have been shown and described, it should be apparent that many modifications can be made thereto without departing from the spirit and scope of the invention. Accordingly, the invention is not limited by the foregoing description, but is only limited by the scope of the claims appended hereto.

We claim:

1. A method for increasing the amount of volatiles produced and decreasing the amount of coke produced from a fixed amount of a vacuum reduced crude from a vacuum distillation tower, comprising:

(a) feeding said vacuum reduced crude from the vacuum distillation tower directly into a coker combination tower;

(b) coking a residuum stripped of volatiles generating coke drum vapor;

(c) feeding said coke drum vapor into said coker combination tower in contact with and in direct countercurrent heat exchange relationship with said vacuum reduced crude in said coker combination tower whereby some of said coke drum vapor is absorbed by said vacuum reduced crude generating a coker combination tower residuum;

(d) feeding said coker combination tower residuum into a resid flash down tower maintained at a pressure below the pressure in the coker combination tower;

(e) fractionating said coker combination tower residuum in said resid flash down tower into a vapor stream and a liquid stream comprising a residuum stripped of volatiles;

(f) feeding said residuum stripped of volatiles to a delayed coke drum and coking said residuum stripped of volatiles as provided in step (b);

(g) condensing said fractionated vapor stream.

2. The method of claim 1 wherein said coker combination tower residuum is heated prior to feeding said coker combination tower residuum into said resid flash down tower.

3. The method of claim 1 wherein said resid flash down tower includes an upper condensing zone and a lower fractionation zone and said upper condensing zone is cooled by a pumparound stram of said condensed vapor.

* * * * *